United States Patent [19]

Donnelly

[11] Patent Number: 4,601,141

[45] Date of Patent: Jul. 22, 1986

[54] BUILDING STRUCTURE EXPANSION APPARATUS

[76] Inventor: Frank Donnelly, 93 Belvedere Ave., Oxford, N.J. 07863

[21] Appl. No.: 620,675

[22] Filed: Jun. 14, 1984

[51] Int. Cl.[4] ..... E04B 5/58

[52] U.S. Cl. ..... 52/126.6; 52/749; 254/89 H

[58] Field of Search ..... 52/66, 67, 122.1, 125.6, 52/126.3, 126.4, 126.5, 126.7, 745, 127.5, 749, 126.6; 254/89 H, 106

[56] References Cited

U.S. PATENT DOCUMENTS

| | | | |
|---|---|---|---|
| 3,325,146 | 6/1967 | Ahl | 254/106 |
| 3,883,106 | 5/1975 | Simonsen | 254/106 |
| 4,058,952 | 11/1977 | Donnelly | 52/125.1 |
| 4,277,052 | 7/1981 | Kallinger | 254/106 |

FOREIGN PATENT DOCUMENTS

| | | | |
|---|---|---|---|
| 2433503 | 8/1975 | Fed. Rep. of Germany | 52/749 |

*Primary Examiner*—William F. Pate, III
*Assistant Examiner*—Jean M. LaKemper
*Attorney, Agent, or Firm*—Marvin A. Naigur

[57] ABSTRACT

An apparatus for expanding a building structure in which the roof structure of an existing building is raised by a plurality of column assemblies, each including an outer section and at least one inner section. A jack assembly is provided which raises each inner section into an extended position relative to its corresponding outer section. A clamping device is mounted on each jack assembly for gripping the inner section and when the extended position is reached the corresponding sections are secured with the clamping device automatically releasing upon downward movement of the jack assembly.

7 Claims, 8 Drawing Figures

4

18
20a
34
10
12
92
90
122
120
36
44
38
40
42
54
32
52
86
66
68
68
48
56
16
14
4

3

18
20a
34
10
92
90
122
120
12
44
36
38
40
42
54
32
52
86
66
68
68
48
56
16
14
3

BUILDING STRUCTURE EXPANSION APPARATUS

BACKGROUND OF THE INVENTION

The present invention relates to an apparatus for expanding a building structure, and more particularly to such an apparatus for raising the roof of a building structure in order to create additional space.

It is well appreciated that, due to the increasing costs of land, materials and labor, the expansion of an existing building structure to create additional space is much more advantageous from an economic standpoint than the construction of a new building.

Although several techniques have been devised to expand an existing building construction, they often only involve expansion onto existing land structures utilizing a common wall or walls of the existing building structure. Although this somewhat reduces the cost of the additional structures, it does not completely eliminate the additional cost of the new land and the new building structure.

Also, in some commercial situations, such as in the use of factories or the like, additional head space, i.e., vertical space above the working area, is needed which dictates a greater roof height. Therefore, an adjoining structure would not only require land adjacent the building but would entail additional costs in constructing a structure with an added roof height.

In applicant's prior invention for EXPANSION OF BUILDING STRUCTURE of U.S. Pat. No. 4,058,952 the general concept of raising the roof of a building has been described. The present invention is a refinement of the concept of applicant's patent, in that a clamping device has been designed for automatically grasping and releasing the columns which are being raised.

Thus, in accordance with the present invention, it is possible to achieve a more continuous roof raising operation that is less labor intensive than was heretofore possible.

SUMMARY OF THE INVENTION

In accordance with an illustrative embodiment demonstrating features and advantages of the present invention, there is provided an apparatus for extending the height of a building in which a plurality of vertically oriented column assemblies are provided, with each assembly including an outer section and at least one inner section telescopically disposed within the outer section. A clamping device is pivotally mounted on each jack assembly for upward movement. The clamping device is capable of securely gripping the inner section during the upward movement of the jack assembly in order to bring and hold the inner section in an extended position. The inner section is maintained in a raised position, and the clamping device is released upon downward movement of the jack assembly in order to permit sequential raising of the inner member. The column assemblies can be made a part of the original building structure to provide for future expansion or can be utilized in a portable manner solely for the purpose of raising the roof.

Thus, in accordance with the apparatus of the present invention, the height of the building structure can be substantially extended to provide additional head space or an additional floor in the building.

BRIEF DESCRIPTION OF THE DRAWINGS

The above brief description, as well as further objects, features, and advantages of the present invention, will be more fully appreciated by reference to the following detailed description of presently preferred but nonetheless illustrative embodiments in accordance with the present invention, when taken in cônnection with the accompany drawings wherein.

DESCRIPTION OF THE PREFERRED EMBODIMENTS

Figure 1:
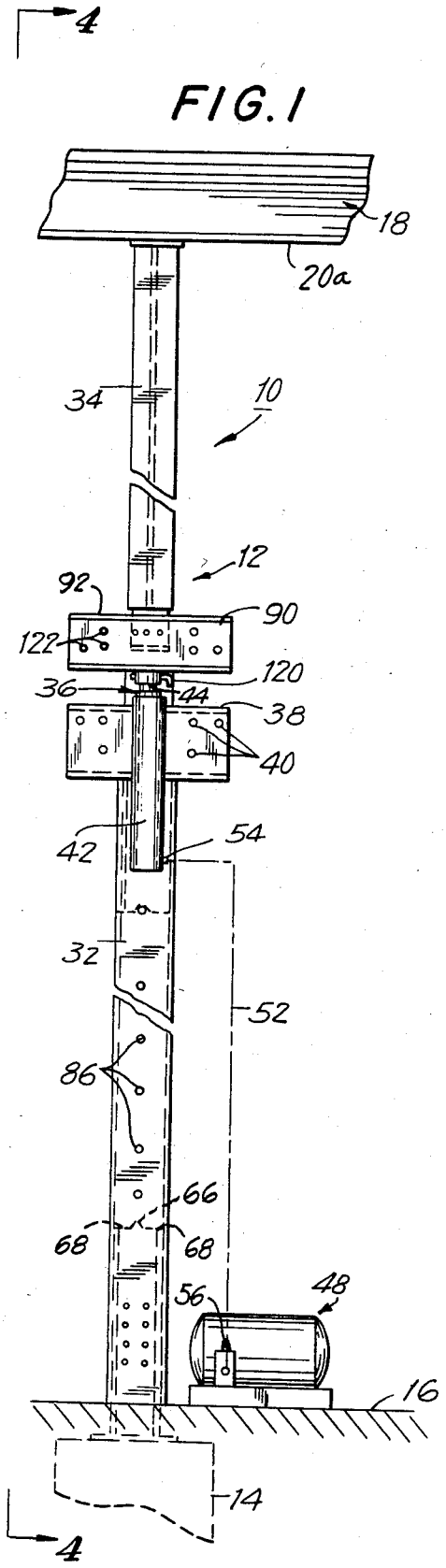
FIG. 1 is a front elevational view of a portion of a structure showing the apparatus of the present invention assembled therein prior to raising the roof structure of the building and part of the outer column is broken away and sectioned to show part of the mating portion of the inner column of the building.
Figure 2:
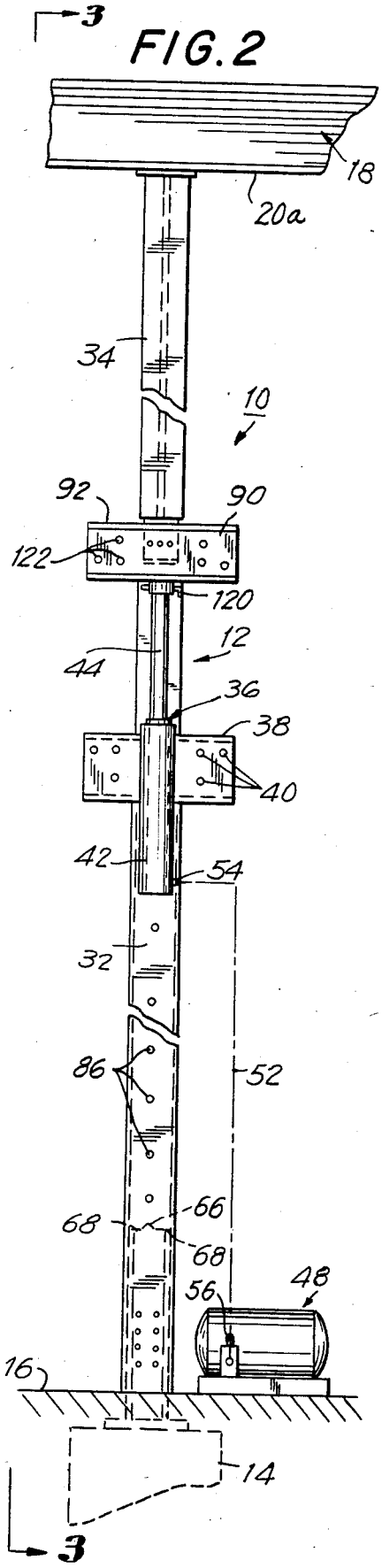
FIG. 2 is a front elevational view similar to FIG. 1, but with the roof structure shown in a raised position.
Figure 3:
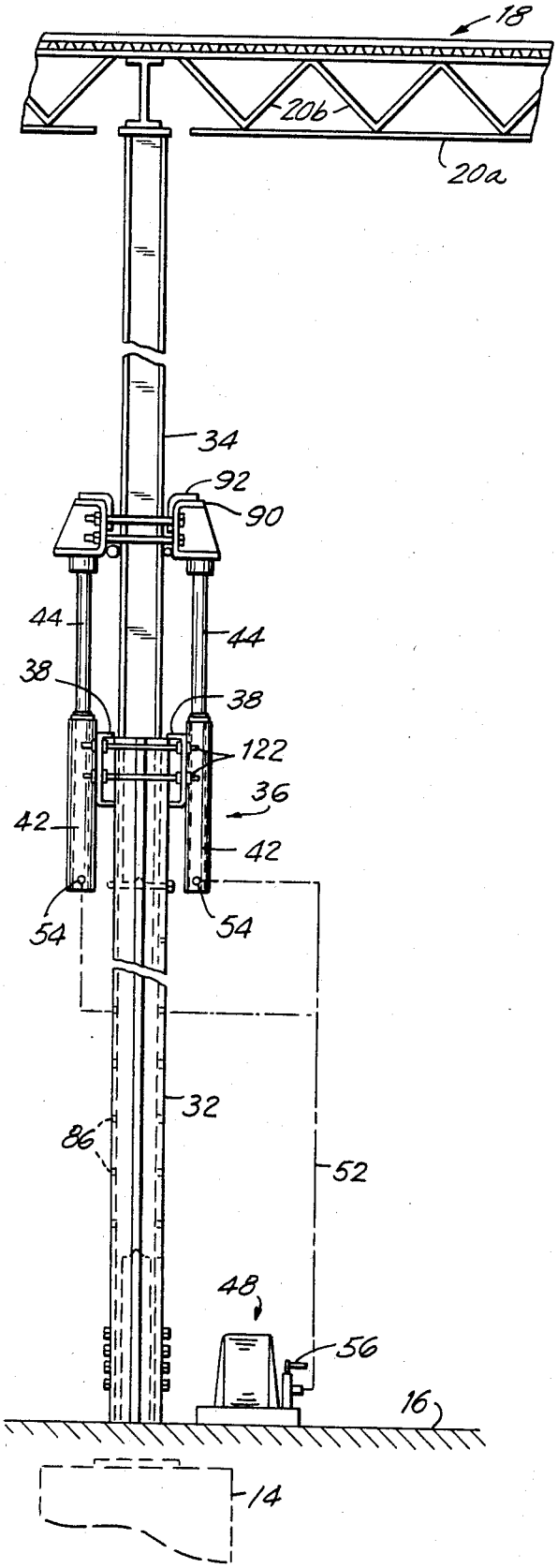
FIG. 3 is a side elevational view of the building structure expansion apparatus of FIG. 2.
Figure 4:
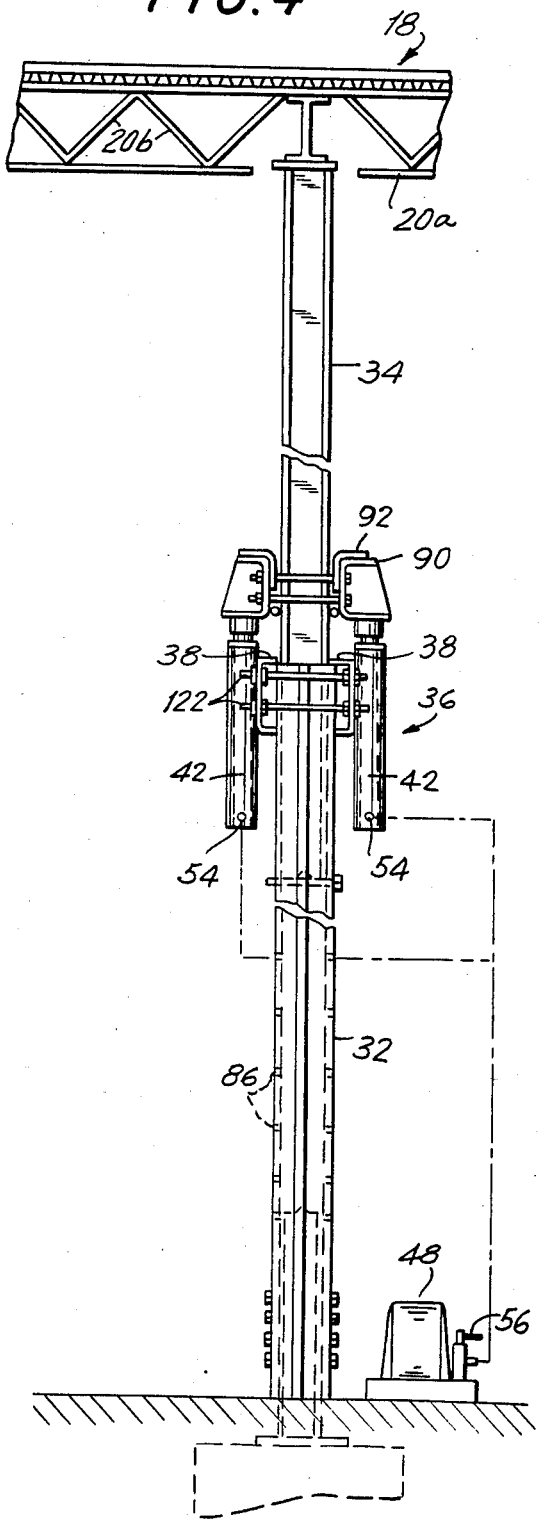
FIG. 4 is a side elevational view of the building structure expansion apparatus of FIG. 1.

With reference to FIGS. 1 and 2, a building structure is referred to in generally by the reference numeral 10 and is formed, in part, by a plurality of support columns, one of which is shown by the reference numeral 12, extending from a footing or foundation 14 and covered by a concrete floor 16. A roof structure 18 is provided in the upper portion of the building 10 and is shown in FIGS. 3 and 4 as having an open truss configuration which consists of a lower horizontal member **20*a* and an upper horizontal member 20*b* separated by a plurality of joists shown schematically by the diagonal lines 22. The members 20*a* and 20*b*** can each be in the form of an I-beam, a wide flange beam or any other similar type girder.

The apparatus according to the present invention consists of a plurality of column assemblies 12 which extend from the floor 16 of the building to the roof structure 18. The column assemblies 12 operate in unison to raise the roof structure to an elevated position shown in FIG. 2 by virtue of an incremental expansion of each of the column assemblies 12 in a vertical direction.

As shown in FIGS. 1 and 2, the column assemblies 12 are respectively shown in a retracted position and in an extended position for convenience of presentation. Each column assembly 12 consists of an outer column 32 surrounding the lower portion of an inner column 34 which is adapted for telescopic movement relative to outer column 32.

A jack assembly is designated by the reference numeral 36 and includes a pair of yokes 38 mounted on the upper end of outer column 32 by means of a pair of three nut-and bolt assemblies 40. As best shown in FIGS. 1 and 2, the nutand-bolt assemblies 40 are positioned outwardly on either side of outer column 32 in order to afford ease of assembly when the jack assemblies 36 are being installed and dismantled. Welded to the yokes 38, is a pair of base cylinders 42 that contain pistons 44 which are preferably hydraulically activated.

In accordance with the present invention, a pair of clamping jaws generally designated 46 is pivotally mounted on the jack assemblies 36 for upward movement when the pistons 44 are activated. As will hereinafter be described in greater detail, the clamping jaws 46 are pivoted against either side of inner column 34 in a vise-like gripping action, as jack piston 44 exerts upward pressure.

An electrically powered hydraulic pump, designated in general by the reference numeral 48, may be placed on the floor 16. The pump 48 is adapted to generate hydraulic pressure which is fed, via a line 52, to a pair of inlet fittings 54 provided on the lower portions of the base cylinders 42. An electric switch and a hydraulic valve, shown in general by the reference numeral 56, are associated with the pump 48 for selectively controlling the amount of fluid passing to the base cylinders 42. While it is possible to operate all of the pumps 48 though a central control system, which has not been shown in the drawings, it is preferred to individually activate each of the pumps 48 through operation of the valve and switch 56 which is provided for each jack assembly 36.

Figure 5:
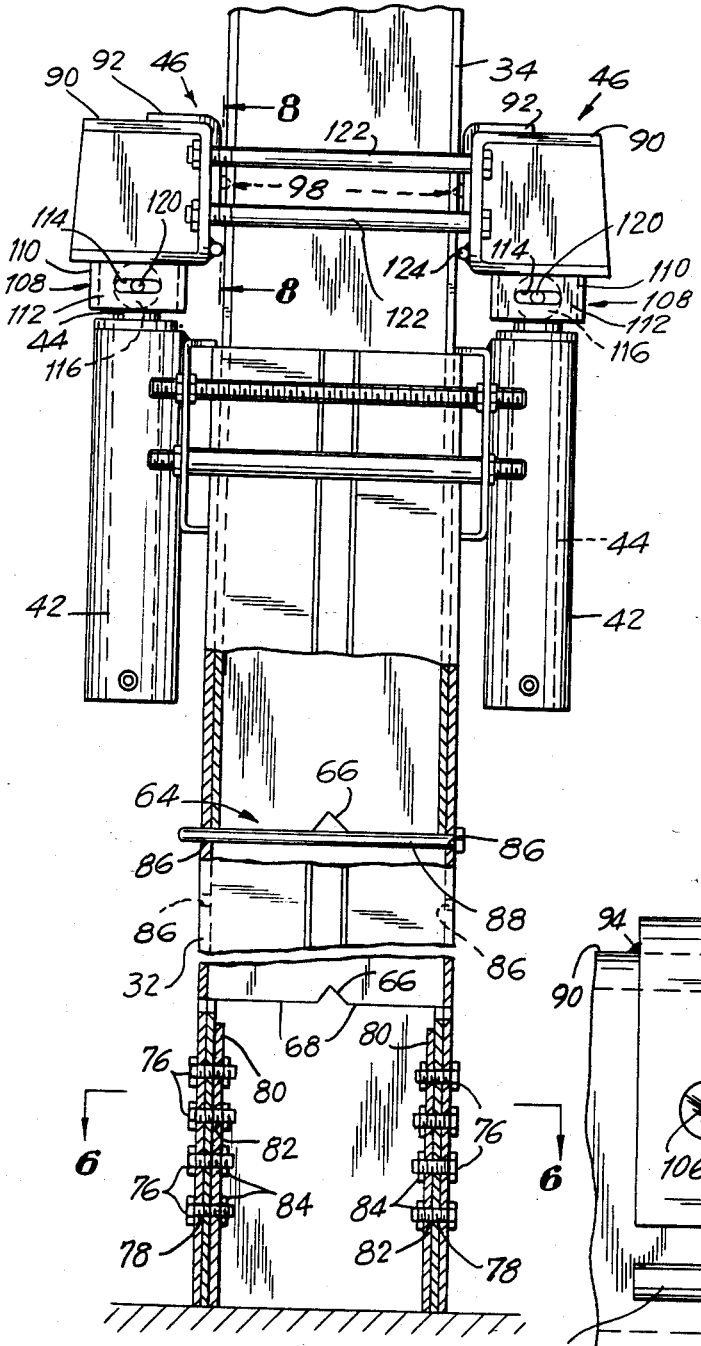
FIG. 5 is an enlarged view of a portion of the building structure expansion apparatus shown in FIG. 4 with portions broken away and sectioned to better show the lower portions of the column assembly.
Figure 6:
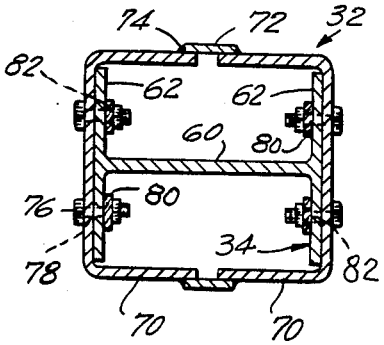
FIG. 6 is a sectional view of the column shown in FIG. 5, taken in the direction of the arrows 6—6.
Figure 7:
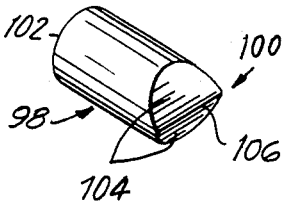
FIG. 7 is an enlarged elevational view of the tips removed from the clamping device shown in FIG. 5.

As best shown in FIG. 6, inner column 34 is preferably what is generally referred to in the steel construction industry as a wide-flanged section which consists of a center web section 60 integrally formed with a pair of opposing flanges 62. By progressively inspecting FIGS. 2 and 5, it can be appreciated that inner column 34 is formed with a transverse break 64 which includes V-shaped cuts 66 on the flanges 62 as well as the web sections 60. On either side of the V-shaped cuts 66 there is provided a pair of horizontal cuts 68 in order to complete the transverse break 64 through the cross section of inner column 34. The V-shaped cuts 66 on flanges 62 and web section 60 serve as a means for retaining the inner column 34 in a vertically oriented load-bearing position, even though the inner column 34 is completely severed through the transverse break 64.

The outer column 32 serves as guide means for maintaining the column assembly 30 in a vertical orientation with respect to the ground level 16 as the roof structure 18 is moved into the fully raised position. Furthermore, as will be more fully described, the outer column 32 is used for securing the columns assembly 30 when it has been moved into the fully raised position.

The structure of outer column 32 comprises a pair of channel supports 70 which are secured by means of a pair of plates 72 that are mounted on opposite sides of the channel supports 70 by means of welds 74. As best shown in FIG. 6 the channel supports 70 are positioned to surround the lower portion of column assembly 30 with sufficient clearance to allow for sliding telescopic movement of inner column 34 within outer columns 32. The movement of inner columns 34 above the transverse break 64 is afforded by the clearance provided between the mating portions of columns 32 and 34.

The channel supports 70 are secured to column 34 by a series of bolts 76 that pass through aligned bores 78 formed in the lower portion of outer column 32 and inner column 34. For ease of assembly, an elongated strip member 80 is provided, which is formed with bores corresponding to aligned bores 78, and nuts 84 are welded over the bores 82. This allows for positioning of the nuts 84 over the aligned bores 78 prior to threadable engagement of the bolts 76. Accordingly, the outer column 32 can be assembled in position, surrounding the inner column 34, by threadably engaging the bolts 76 and nuts 78. Thereafter, the welds 74 are made on the plates 72 to secure them in place and complete the structure of outer column 32. It should be understood that the transverse break 64 must be cut through the cross-section of inner column 34 prior to assembly of outer column 32 as outlined above. This can be appreciated by referring to FIG. 5 which depicts a column assembly 30 in a partially raised condition. However, if a building structure is to have roof raising capability installed during the initial construction phase of the building, it would be necessary to provide for means for removably securing the portion of inner column 34, above the transverse break 64, to the outer column 32. This could be achieved by providing a second set of bolts and nuts similar to bolts 76 and nuts 78 which would be installed above transverse break 64 and removed at a later time when the roof is to be raised.

As best shown in FIGS. 3 and 4, a series of vertically spaced, diametrically opposed pairs of openings 86 extend through the outer columns 32. An elongated rod 88 is provided, which is adapted to extend through a selected pair of openings 86. The length of each rod 88 is sufficient to pass completely through the outer column 32. Accordingly, the series of openings 86 on column 32 are spaced approximately six to twelve inches apart along the vertical axis of the column 32. As will be described in detail later, when the jack assembly 36 reaches the extended position of FIGS. 2 and 3, the rod 88 is inserted into the aligned openings 86 prior to release of the jack assemblies 36 for movement in the downward direction.

Figure 8:
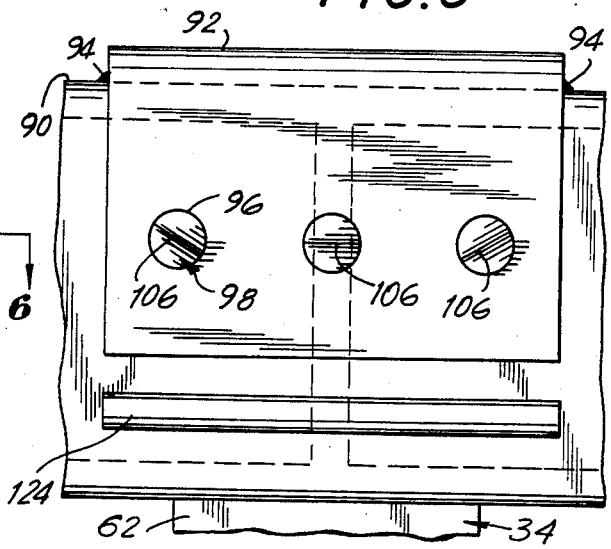
FIG. 8 is an enlarged sectional view of the clamping device, taken in the direction of the arrows 8—8 in FIG. 5.

Referring to FIGS. 5 and 8, each pair of clamping jaws 46 is comprised of a pair of U-shaped cross-section mounting plates 90, to each of which there is welded a face plate 92 having an L-shaped cross-section. By progressively inspecting FIGS. 1 and 5 it can be appreciated that the mounting plates 90 extend beyond opposite sides of inner column 34 and are substantially the same size as the yokes 38. However, the face plates 92 are of a smaller transverse width than the mounting plates 90, and have smaller extended sections on opposite sides of inner column 34.

In FIG. 8, the face plate 92 is, shown as fixed to the mounting plate 90 by means of welds 94 and, formed with openings 96 for receiving tips 98. The tips 98 are of a general cylindrical shape, with a gripping tooth 100 integrally formed at one end and a circular flat section 102 formed at the other end. The gripping tooth 100 is formed with a pair of concave lands 104 that meet at a relatively sharp cutting edge 106. The openings 96 are sized to receive the cylindrical portion of tips 98 in a relatively snug fit, in order for the tips 98 to be easily positioned in openings 96. In this manner, the flat sections 102 contact the outer surface of mounting plate 90 and the gripping teeth 100 contact the outer surface of flange sections 62 when the gripping jaws 46 are activated, as will be more fully described. The tips 98 are fabricated from extremely hard, abrasion resistant tungsten alloy carbide in order that the gripping teeth 100 can impinge on and break the surface of the flange section 62. Also, the tips 98 can be rotated with the cutting edges 106 positioned at different angles as shown in FIG. 8 to obtain positive and distributed gripping action when the gripping jaws 46 are activated. Thus, it is important that the tips 98 be fabricated from a material which has a hardness coefficient much greater than the hardness coefficient of the steel, which is used to fabricate the inner columns 34, with alloys of tungsten carbides being the preferred material for the tips 98 in accordance with the present invention.

The gripping jaws 46 are mounted on jack assembly 36 by means of a pair of pivotal connection assemblies 108 between mounting plate 90 and the uppermost end of jack piston 44. The pivotal connection assembly 108 includes: a mounting block 110 formed from spaced apart plates 112 with opposing elongated slots 114, and the upper end of mounting block 110 is welded to mounting plate 90; a mounting cylinder 116 is formed with a bearing slot aligned between the elongated slots 114, secured to the top of piston 44; and an L-shaped pin 120 removably positioned in the elongated slots 114 and the bearing slot in mounting cylinder 116. Thus, the mounting cylinder 116 is shown by the broken-line circle in FIG. 5 having a bearing slot which is coextensive with the aligned elongated slots 114. When the pin 120 is inserted through the first elongated slot 114, and bearing slot of mounting cylinder 116 and the second elongated slot 114, the pivotal connection assembly 108 has been achieved. The elongated slots 114 and aligned bearing slot of mounting cylinder 116 allow for play about the pin 120, such that deflection is imparted to the gripping jaws 46 as the jack piston 44 is activated upward.

The gripping jaws 46 are maintained in position on inner column 34 by means of nut-and-bolt assemblies 122 which are similar to the nut-and-bolt assemblies 40 on yoke 38. By referring to FIGS. 1 and 5, it can be seen that a pair of three nut-and-bolt assemblies 122 are secured to each pair of mounting plates 90. The mounting plate 90 is also provided with a shim bar 124, and prior to upward movement of the jack pistons 44, the nut-and-bolt assemblies 122 are tightened to bring the shim bar 124 and tips 98 into contact with the outer surfaces of flange sections 62. The nut-and-bolt assemblies 122 are sufficiently tightened to apply enough pressure to allow the tips 98 to grasp the flanges 62 when upward pressure is applied through jack pistons 44 and to release and slide downward when the upward pressure is released upon downward movement of jack pistons 44. Accordingly, as each of the jack pistons 44 moves vertically upward through activation of the hydraulic pump 48, the vertical moment of force created by piston 44 is translated through the pin 120 to achieve pivotal action of mounting plate 74, about shim bar 124, in opposing directions for each of the two gripping jaws 46.

As will be more fully appreciated in connection with the operation of the present invention, the rod 88 and opening 86 allow the accomplishing of a series of column lifts by the following steps: raising the jack piston 44; inserting the rod 88 in the opening 86 directly below the transverse break 64 of inner column 34; releasing the jack piston 44 such that the gripping jaws 46 will sufficiently disengage inner column 34 to allow the transverse break section 64 to engage positioning rod 88; and sliding the jack piston 44 and gripping jaws 46 into the fully retracted downward position of FIG. 5.

Before operation of the assemblies of the present invention, the roof structure 18 is detached from the remaining building structure, exclusive of the vertical column assemblies 12, in any conventional manner such as by weld burning, disassembly of any fastening means and the like.

The column assemblies 12 are located at spaced intervals within the building with the pistons 44 of the hydraulic jack assemblies 36 in their retracted positions as shown in FIGS. 1 and 4. The pistons 44 of the jack assemblies 36 are then extended upwardly by applying hydraulic pressure from the pumps 48 to the base cylinders 42 by activating the valve and switch 56. This causes the gripping jaws 46 on the left side of FIG. 5 to pivot in a clockwise direction and the gripping jaw 46 on the right side of FIG. 5 to pivot in a counter clockwise direction such that the gripping jaws 46 grip inner column 34 during the upward movement of pistons 44.

With the column assemblies 12 all operating in this manner in unison, the roof structure 18 is raised a distance corresponding to the length of extension of the pistons 44. After the pistons 44 attain their maximum extended position as shown in FIGS. 2 and 3, elongated rods 88 are inserted into the aligned openings 86. The pistons 44 are then retracted in a downward direction back into their base cylinders 42 by releasing the hydraulic pressure in line 52. The aforementioned retraction of the pistons 44 causes the gripping jaws 46 to release engagement with inner columns 34, such that the transverse break 64 of inner column 34 is supported on elongated rod 88 and the gripping jaws 46 slide downwardly on inner column 34.

The roof structure 18 is thus raised in increments in accordance with the foregoing until it attains the desired elevation in the building. Then the inner column 34 can be secured to the outer column 32 and the structure connected and welded as needed.

Additional modifications, changes and substitutions are intended in the foregoing disclosure, and, in some instances, some features of the invention will be employed without corresponding use of other features. Accordingly, it is appropriate that the appended claims be construed broadly and in a manner consistent with the spirit and scope of the invention herein.

What is claimed is:

1. Apparatus for extending the height of a building comprising:

a plurality of columns which are vertically oriented with respect to ground level;

each column comprising an outer section and at least one inner section telescopically disposed within said outer section;

at least one jack assembly including a pair of jacks mounted to said outer section and adapted to move upward and downward, said jack assembly operatively connected to said inner section for raising said inner section into an extended position relative to said outer section in response to the upward movement of said jack assembly;

clamping means including a pair of gripping jaws pivotally mounted on said jack assembly for said upward movement, with said gripping jaws securely gripping said inner section during said upward movement to bring and hold said inner section in said extended position;

each of said gripping jaws of each pair of gripping jaws positioned in opposing relationship to each other, such that said gripping jaws grasp said inner section upon said upward movement of said jack assembly;

means for maintaining said inner section secured to said outer section and mounted between said gripping jaws, such that said gripping jaws can be brought into releasably secured contact with said inner section;

said clamping means being released upon downward movement of said jack assembly;

said inner section being fabricated from steel in the form of a wide flange beam having an I-shaped cross sectional configuration integrally formed with a pair of flanges separated by a web, said gripping jaws contacting the exterior surfaces of said flanges;

said means mounted between said gripping jaws including a nut-and-bolt assembly journalled and releasably secured between said gripping jaws;

each of said jacks mounted on the top of said outer section including a piston adapted for movement in an upward direction and in a downward direction along the vertical axis of said column, a pivotal connection assembly mounted between said piston and the respective gripping jaw, such that upward movement of said piston will create a vertical moment of force through said pivotal connection assembly to achieve pivotal action of said gripping jaws against said inner section; and said gripping jaws including a pair of mounting plates secured to said pivotal connection assembly, and tips on said mounting plates fabricated from material of a hardness coefficient sufficiently greater than the hardness coefficient of said steel of said inner section, such that said tips will impinge the steel surface of said inner section upon said upward movement of said piston.

2. Apparatus according to claim 1, in which said tips are fabricated from carbides of tungsten.

3. Apparatus according to claim 1, in which each of said mounting plates is formed with at least one cylindrically-shaped opening, and said tips are shaped at one end with a flat section for mounting in said opening and at the other end with a cutting edge for contacting said steel surface of said inner section.

4. Apparatus according to claim 3, in which a plurality of tips are mounted on each of said mounting plates, with the cutting edge of at least two of said tips being rotated at different angles in said cylindrically-shaped opening such that the gripping action of said gripping jaws is distributed and increased.

5. Apparatus for extending the height of a building comprising:

a plurality of columns which are vertically oriented with respect to ground level;

each column comprising an outer section and an inner section telescopically disposed within said outer section;

a pair of jacks mounted on said outer section adapted to move upward and downward and each of said jacks operatively connected to said inner section for raising said inner section into an extended position relative to said outer section in response to the upward movement of said jacks;

a pair of gripping jaws pivotally mounted on said jacks for said upward movement, and each of said gripping jaws positioned in opposing relationship to each other for securely grasping said inner section during said upward movement to bring and hold said inner section in said extended position;

each of said jacks mounted on the top of said outer section and includes a piston adapted for movement in an upward direction and in a downward direction along the vertical axis of said column, a pivotal connection assembly mounted between said piston and the respective gripping jaw, such that upward movement of said piston will create a vertical moment of force through said pivotal connection assembly to achieve pivotal action of said gripping jaws against said inner section;

said gripping jaws including a pair of mounting plates secured to said pivotal connection assembly, and tips on said mounting plates fabricated from material of a hardness coefficient sufficiently greater than the harness coefficient sufficiently greater than the harness coefficient of said steel of said inner section, such that said tips will impinge the steel surface of said inner section upon said upward movement of said piston; and means for maintaining said inner section secured to said outer section and said gripping jaws released upon downward movement of said jack assembly.

6. Apparatus according to claim 5, in which said tips are fabricated from carbides of tungsten.

7. Apparatus according to claim 6, in which a plurality of said tips are formed with cutting edges and secured to each of said mounting plates, with the cutting edge of at least two of said tips being rotated at different angles such that the gripping action of said clamping jaws is distributed and increased.

* * * * *